United States Patent [19]

Anthony

[11] 4,391,053

[45] Jul. 5, 1983

[54] VISOR PICTURE FRAME

[75] Inventor: Alfred Anthony, Westport, Conn.

[73] Assignee: Yankee Metal Products, Inc., Norwalk, Conn.

[21] Appl. No.: 268,773

[22] Filed: Jun. 1, 1981

[51] Int. Cl.[3] ..... A47G 1/06; G09F 1/12; B60J 3/00

[52] U.S. Cl. ..... 40/152; 40/154; 40/156; 40/157; 296/97 C; 224/314

[58] Field of Search ..... 40/152, 152.1, 152.2, 40/154, 155, 156, 10 R, 10 A, 10 B, 11 R, 593, 591, 606; 224/312; 296/97 C; 248/467

[56] References Cited

U.S. PATENT DOCUMENTS

| | | | |
|---|---|---|---|
| 1,052,505 | 2/1913 | Munger et al. | 40/11 R |
| 2,218,409 | 10/1940 | Smalls | 40/152 |
| 2,531,295 | 11/1950 | Ritchie | 40/11 R |
| 2,803,902 | 8/1957 | Shedd | 40/107 |
| 2,867,925 | 1/1959 | Botts | 40/10 R |
| 3,813,799 | 6/1974 | Caravello | 40/152 |
| 3,954,297 | 5/1976 | Linke et al. | 296/97 C |
| 4,023,854 | 5/1977 | Nack, Jr. | 296/97 C |
| 4,103,860 | 8/1978 | Haas et al. | 248/467 |
| 4,241,859 | 12/1980 | Eames | 224/312 |
| 4,314,417 | 2/1982 | Cain | 40/152 |

*Primary Examiner*—Gene Mancene
*Assistant Examiner*—Michael J. Foycik
*Attorney, Agent, or Firm*—Barry R. Lipsitz

[57] ABSTRACT

A frame assembly is adapted to be detachably secured to the sun visor of an automotive vehicle or the like. The frame may alternatively be hung on a wall or may stand on a supporting surface such as a table. The assembly consists of an outer frame member having resilient clips attached thereto. Each clip provides two different contact points for gripping a supporting surface. A front panel having openings through which pictures can be viewed is affixed to the frame member. A backing plate on which pictures may be mounted is then snapped into place behind the front panel. A transparent window may be provided between the backing plate and front panel to protect the pictures. A reflective surface may be provided on the backing plate so that a mirror will show through any of the front panel openings not having a picture mounted behind it. A mirror may also be attached to the clips of the frame assembly such that it will come into view when the visor to which the frame assembly is mounted is flipped to its rear side.

13 Claims, 15 Drawing Figures

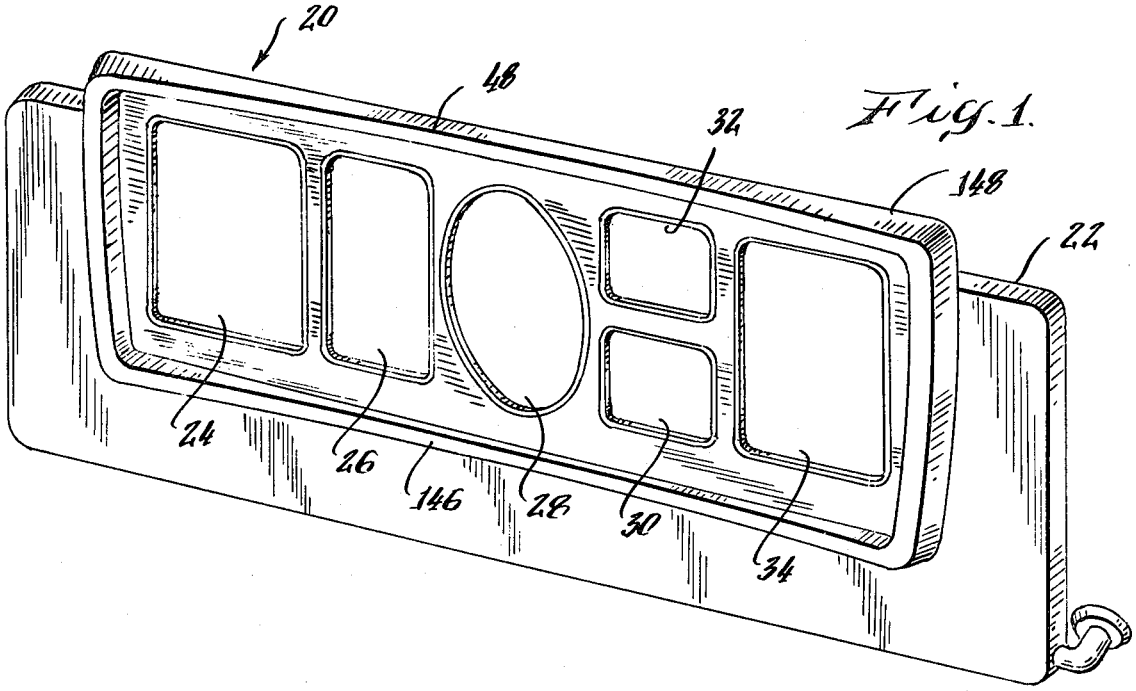
Fig. 1.
Fig. 5.
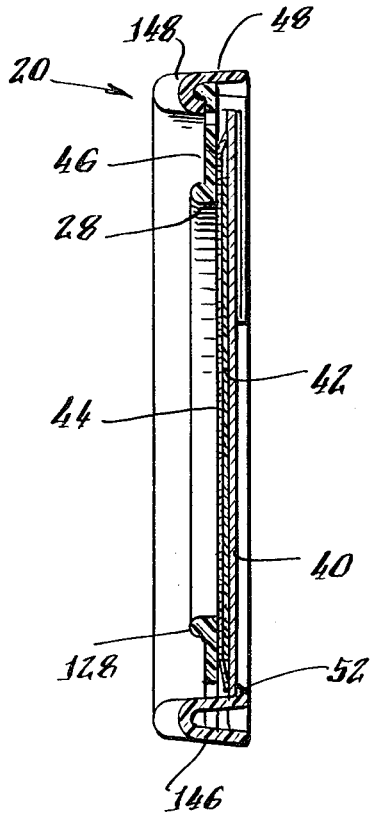
Fig. 6.
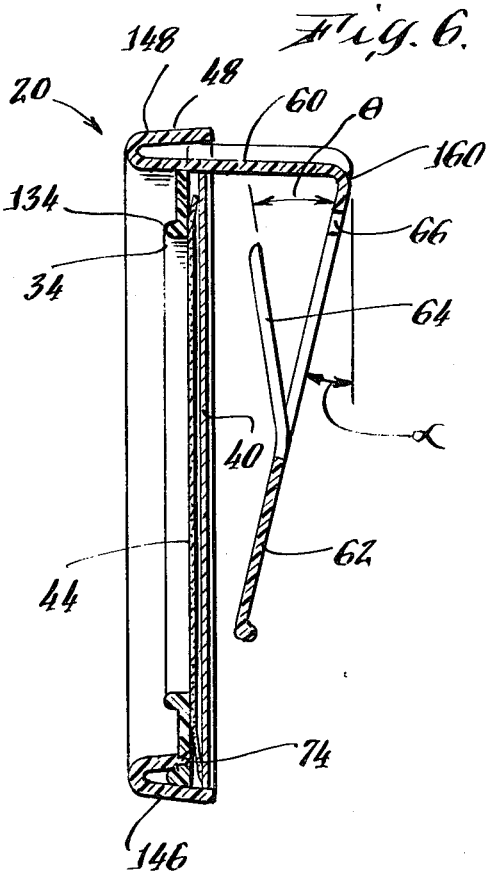

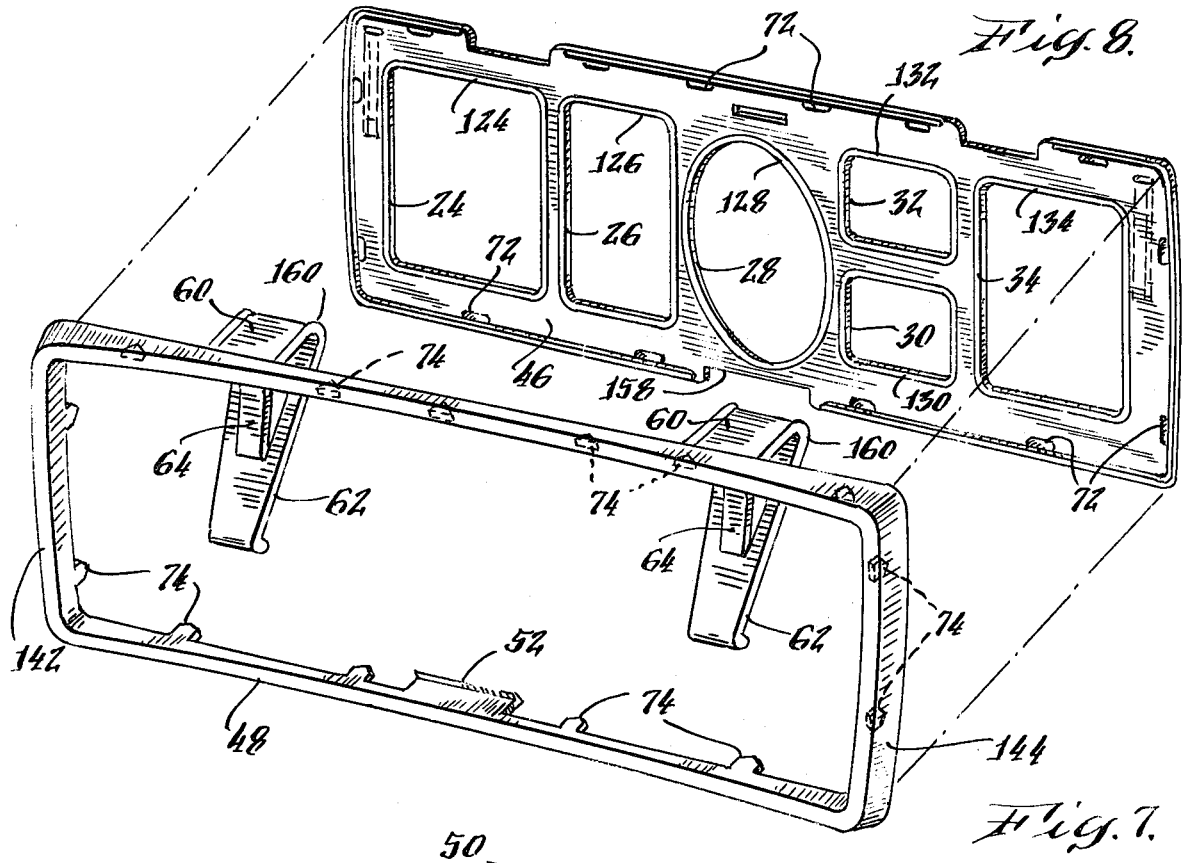
Fig. 8.
Fig. 7.
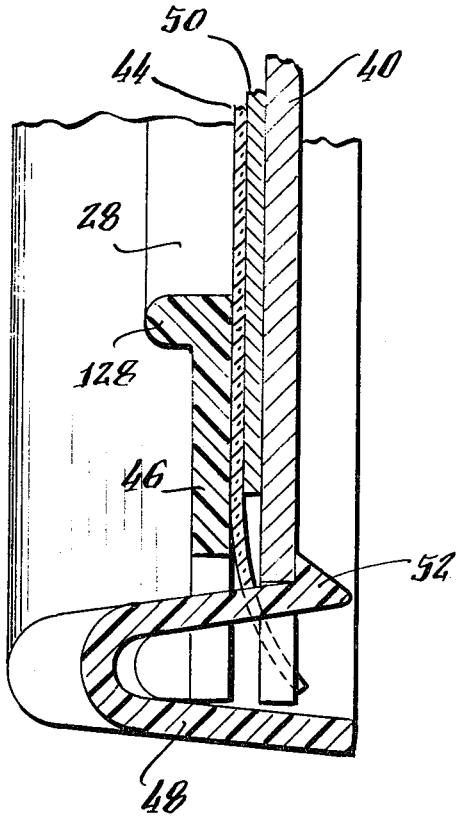
Fig. 14.

VISOR PICTURE FRAME

BACKGROUND OF THE INVENTION

This invention relates to a picture frame assembly adapted to be detachably secured to the sun visor of an automotive vehicle or the like. The frame may alternatively be hung on a wall or may stand on a supporting surface such as a table.

In the past various holders have been provided for attachment to the visor of a motor vehicle. For example, U.S. Pat. No. 2,531,295 shows a device for attaching and holding in position on a sun visor a vehicle registration card. U.S. Pat. No. 2,803,902 shows a visor attached calendar. U.S. Pat. Nos. 2,867,925; 3,954,297; 4,103,860; and 4,241,859 show visor mounted holders for maps, glare shields, mirrors, and tape cassettes or cartridges respectively. French Pat. No. 1,212,525 shows a visor holder which contains a mirror and a photograph. Each of these patents illustrates the use of one or more clips to hold the device on the sun visor. However, none of these patents shows an integral clip having a pair of spaced points in contact with the visor to provide an improved gripping force.

Past article holders for mounting on a sun visor do not deal with the display of a plurality of a pictures or photographs. Therefore, none of the prior devices include easy access for mounting a plurality of pictures in centered relation to openings which provide an attractive border around the pictures.

Further, past visor mounted devices were limited to mountings solely on a sun visor of a motor vehicle or other similar planar supporting surface of nominal thickness. No provision was made to hang such devices on a wall or to sit them on a table in an upright position.

It would be advantageous to provide a visor mounted picture frame that would enable the display of a plurality of user selected pictures. The frame should provide easy access to the user for inserting and removing pictures. It would be further advantageous for the frame to provide the option of having one or more mirrored surfaces available at locations selected by the user. The frame should also have the flexibility to allow it to be hung on a wall or stood on a table to display pictures.

This invention relates to such a frame.

SUMMARY OF THE INVENTION

The picture frame of the present invention consists of a frame assembly which can be detachably secured to the sun visor of an automotive vehicle or the like. The assembly contains a rigid frame member into which a front panel is affixed. The front panel has a plurality of viewing openings which define borders around pictures which a user inserts into the picture frame. The pictures are removably mounted on a backing plate which is positioned within the frame member and behind the front panel. The backing plate may have a mirrored front surface to provide a mirror behind any of the front panel viewing openings where no picture is inserted by the user.

The frame assembly also includes at least one clip for mounting the assembly to a sun visor. The clip includes a pair of generally parallel spaced edges for contacting the sun visor in gripping relation thereto. The clip, or clips if more than one is used, may have a hole or slot in it to enable the frame assembly to be hung on a wall, e.g. by using a nail or a picture frame hook in a conventional manner. The shape of the clip or clips may also be such that the frame assembly may be stood in an upright position on a table or shelf.

In order to mount the pictures on the backing plate, slits may be provided into which the corners of the picture can be inserted. The arrangement of the slits is such that each picture will be centered relation to one of the viewing openings when the backing plate containing the pictures is properly mounted within the frame member and behind the front panel. A sheet of transparent material may be sandwiched between the front panel and the backing plate to protect the pictures from dirt and the like. Like the pictures, the sheet of transparent material may be held into the backing plate by the use of corner slits.

To provide an attractive assembly, the viewing openings in the front panel may be of different sizes and shapes. Also, a separate mirror may be mounted to the rear surface of the mounting clip or clips so that the mirror comes into view when the sun visor is rotated about its hinge.

When the components of the frame assembly are manufactured from plastic, the front panel may be affixed to the rigid frame member through the use of pins protruding from the frame member into receptacles on the front panel. The pins may be permanently heat staked. The backing plate may be mounted to the frame member in a removable manner through the use of a pair of channels at opposed edges of the front panel and a resilient locking tab which holds an otherwise free edge of the backing plate in a proper position.

BRIEF DESCRIPTION OF THE DRAWINGS

FIG. 1 is an illustration of the frame assembly of the present invention mounted on an automobile sun visor;

FIG. 5 is a cross-sectional view of the frame assembly taken substantially along the plane indicated by line 5—5 of FIG. 3;

FIG. 6 is a cross-sectional view of the frame assembly taken substantially along the plane indicated by line 6—6 of FIG. 3;

FIG. 7 is a view of the rigid frame member of the frame assembly;

FIG. 8 is a view of the front panel of the frame assembly;

FIG. 14 is an enlarged detail view of the locking tab shown in FIG. 5.

DETAILED DESCRIPTION OF THE PREFERRED EMBODIMENT

Figures 2, 3, 4:
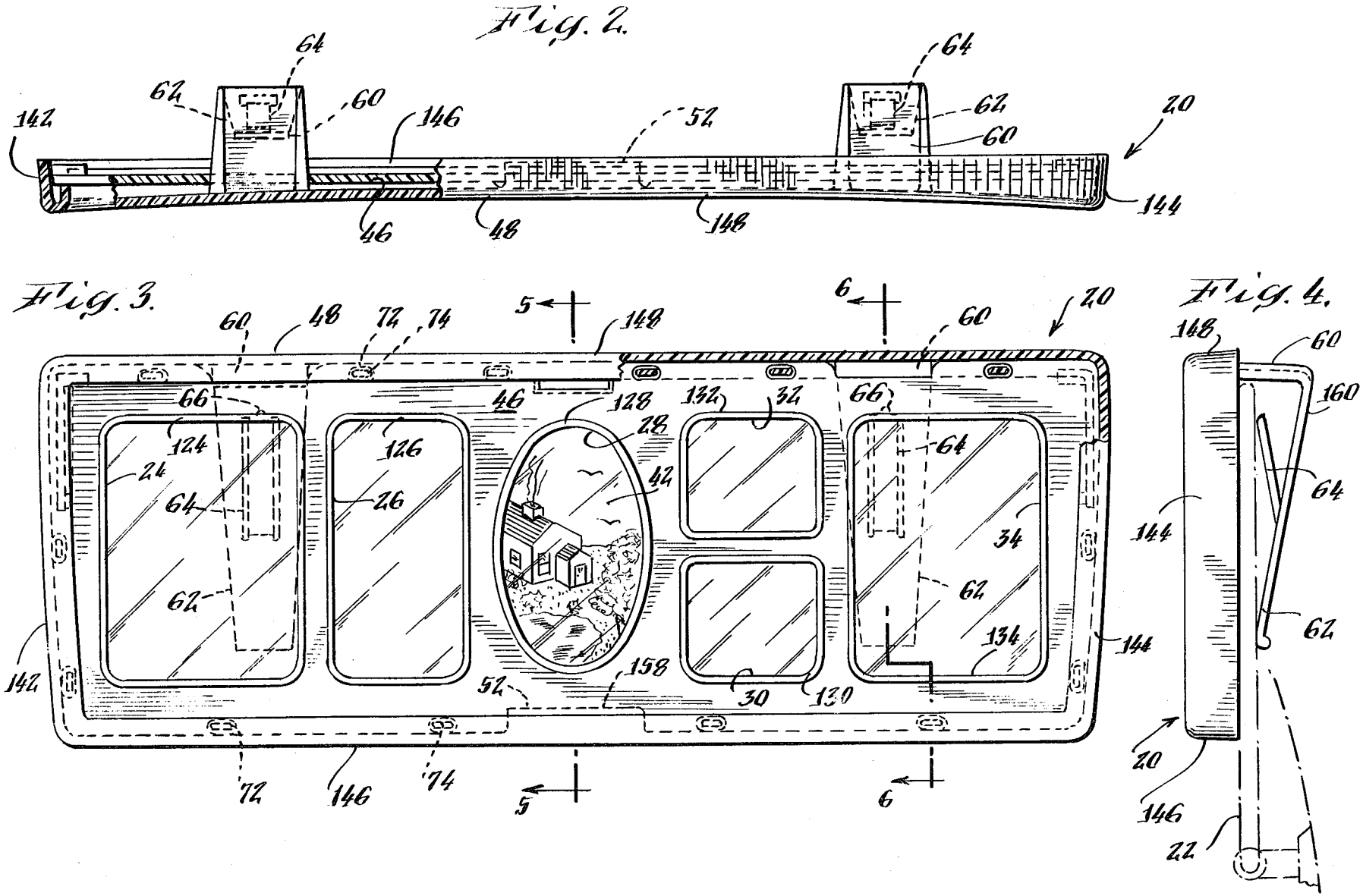
FIG. 2 is a top view of the frame assembly which is cut away to show the backing plate mounted therein and the visor clips.
FIG. 3 is a front view of the frame assembly showing details of the mounting of various components thereof.
FIG. 4 is a side view of the frame assembly shown mounted on a sun visor.

As shown in FIG. 1, the present invention comprises a picture frame 20 having a plurality of openings 24, 26, 28,30, 32 and 34 which provide borders for individual pictures (not shown) mounted therein. Visor mounted picture frame 20 is an assembly of a frame member 48 shown most clearly in FIG. 7, a front panel 46 shown most clearly in FIG. 8, and a backing plate 40 shown clearly in FIG. 9.

As shown in FIG. 7, frame 48 comprises bottom member 146 and top member 148 connected by side members 142, 144. Protruding from the rear sides of these members are a plurality of stake pins 74. Also attached to frame 48 are resilient clips 160 composed of top portions 60 and bottom portions 62. Clips 160 enable picture frame 20 to be mounted in various manners such as on a visor, on a wall, or sitting on a table as described in more detail below. Clips 160 include gripper arms 64 which extend upwardly therefrom and inwardly toward frame 48. When picture frame 20 is placed on a visor 22 as shown in FIG. 4, the top edges of gripper bars 64 will contact visor 22 in gripping relation thereto. Similarly, the bottom edges of bottom portions 62 exert a spring force against visor 22. The combination of spring force exerted on visor 22 by gripper arms 64 and bottom portions 62 provides an extremely effective mechanism by which to mount picture frame 20 onto the thin supporting surface of the visor. Such a mounting method is particularly important in an automotive environment where the constant vibration caused by the movement of the vehicle over the road surface renders clips with only a single contact point less satisfactory.

Figure 13:
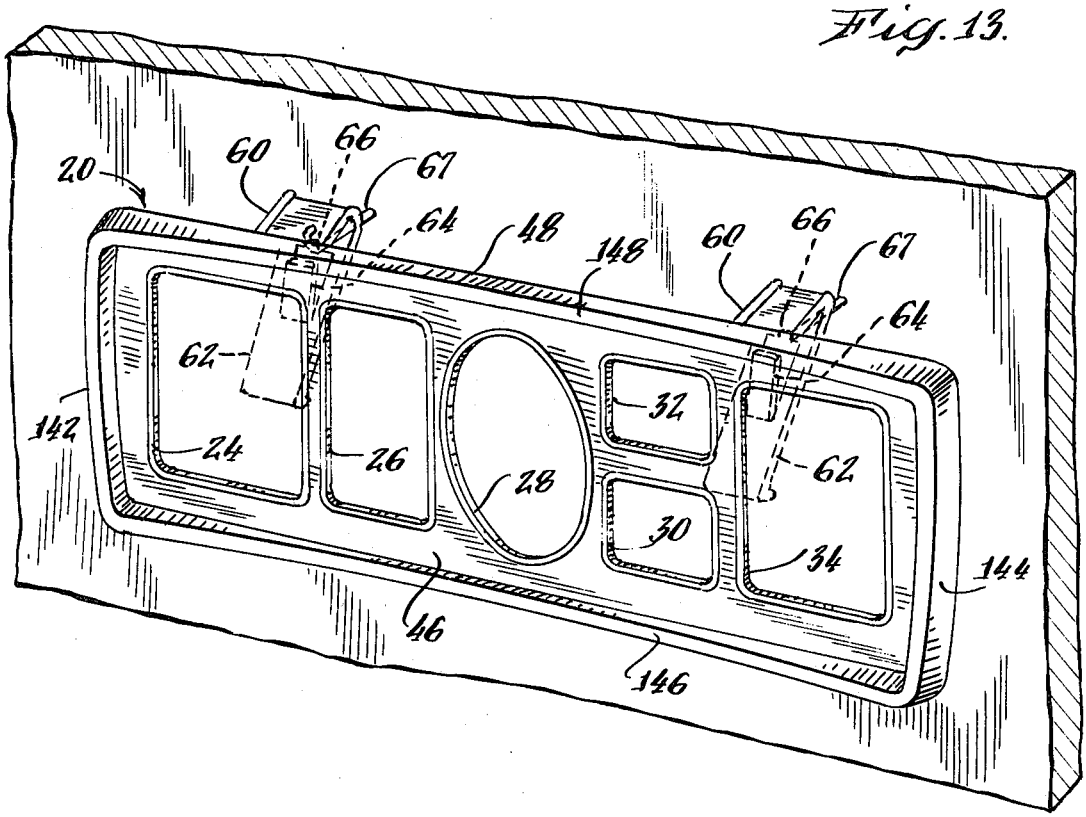
FIG. 13 is a view showing the frame assembly hanging on a wall.

Clips 160 also contain notches 66 which enable picture frame 20 to be hung on a wall. As shown in FIG. 13, nails 67 or conventional picture frame hooks are attached to the wall surface at a distance equal to the distance between notches 66 on picture frame 20. Picture frame 20 is then hung on the wall by placing notches 66 over the corresponding nails or hooks extending from the wall surface.

Also provided on frame member 48 is locking tab 52. As shown in FIG. 7, tab 52 is centered on the inside of bottom portion 146 of the frame. The function of locking tab 52 will be described in detail below in conjunction with the description of the installation of backing plate 40 into the frame assembly.

Frame member 48 provides the outer edges of picture frame assembly 20. A front panel 46 is permanently mounted within frame member 48. As shown in FIG. 8, front panel 46 includes openings 24, 26, 28, 30, 32 and 34 which will serve as viewing ports for individual pictures mounted behind them. Like frame member 48, front panel 46 may be molded from an appropriate plastic such as those sold under the trademarks "CELCON" or "DELRIN". Since the frame assembly will be used in the automotive environment, it is important that the materials be able to withstand the range of temperature which is typical to the interior of an automobile. Thus, for example, the material should be capable of withstanding a temperature of 200° F. without distorting.

The openings in front panel 46 may have molded edges around the perimeter thereof as designated in FIG. 8 by reference numerals 124, 126, 128, 130, 132 and 134. A simulated wood grain texture may also be provided on the surface of front panel 46. Methods for producing such a texture as well as other textures are well known in the art. Notch 152 in front panel 46 is provided to enable locking tab 52 on frame member 48 to extend beyond the rear surface of front panel 46 when the front panel and frame are assembled.

Figure 11:
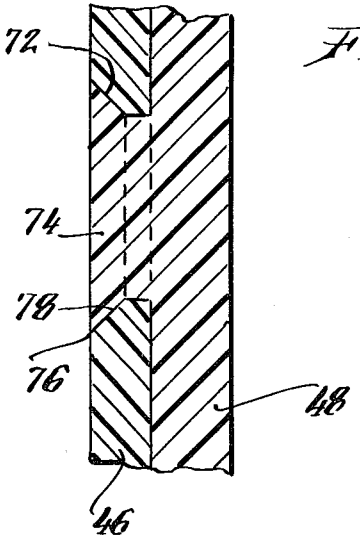
FIG. 11 is a cross-sectional view taken substantially along the plane indicated by line 11—11 of FIG. 10.
Figure 10:
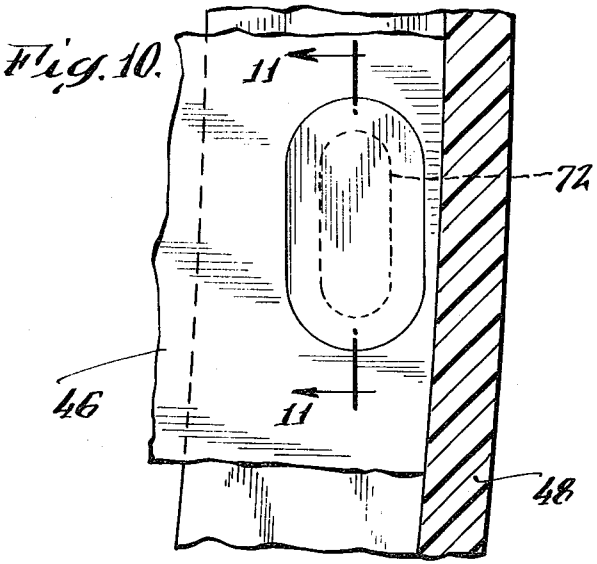
FIG. 10 is an enlarged detail view of one of the stake pin receptacles located in the front panel of the frame assembly.

Front panel 46 also includes a plurality of receptacles 72 around the perimeter thereof. Each of receptacles 72 corresponds to one of the stake pins 74 which protrude from frame member 48. To assemble front panel 46 to frame member 48, the receptacles 72 of the front panel are aligned over their corresponding stake pins 74. Front panel 46 is then pressed up against frame member 48 and the stake pins 74 are heated and compressed so that they melt into receptacles 72 to provide a permanent joint. The process of pushing stake pins 74 into receptacles 72 through the use of heat and pressure is known in the art as "heat staking". As shown in FIGS. 10 and 11, receptacles 72 have beveled edges which taper inwardly. Thus, outer edge 76 of receptacle 72 is of larger diameter than inside edge 78. This frustum-shaped cavity in receptacle 72 provides an area into which the plastic from a corresponding stake pin 74 can flow to provide the desired permanent joint. It will be appreciated by those skilled in the art that methods of joining front panel 46 to frame member 48 other than heat staking could also be used. For example, front panel 46 could be glued to frame member 48 with a suitable adhesive.

Notches 154 and 156 in front panel 46 provide clearance for front panel 46 to fit around top portions 60 of clips 160.

Channels 54 are provided at opposed edges on the back of front panel 46. These channels provide an area into which backing plate 40, shown in FIG. 9, can slide. Backing plate 40 serves as a mounting member for the pictures which a user wishes to display in picture frame 20. Backing plate 40 can be formed of either a plastic or paperboard material. The plastic or paperboard may have a reflective coating thereon to provide a mirrored surface which will be visible through any of the openings 24, 26, 38, 30, 32 or 34 in front panel 46 which do not have a picture mounted behind them.

Figure 9:
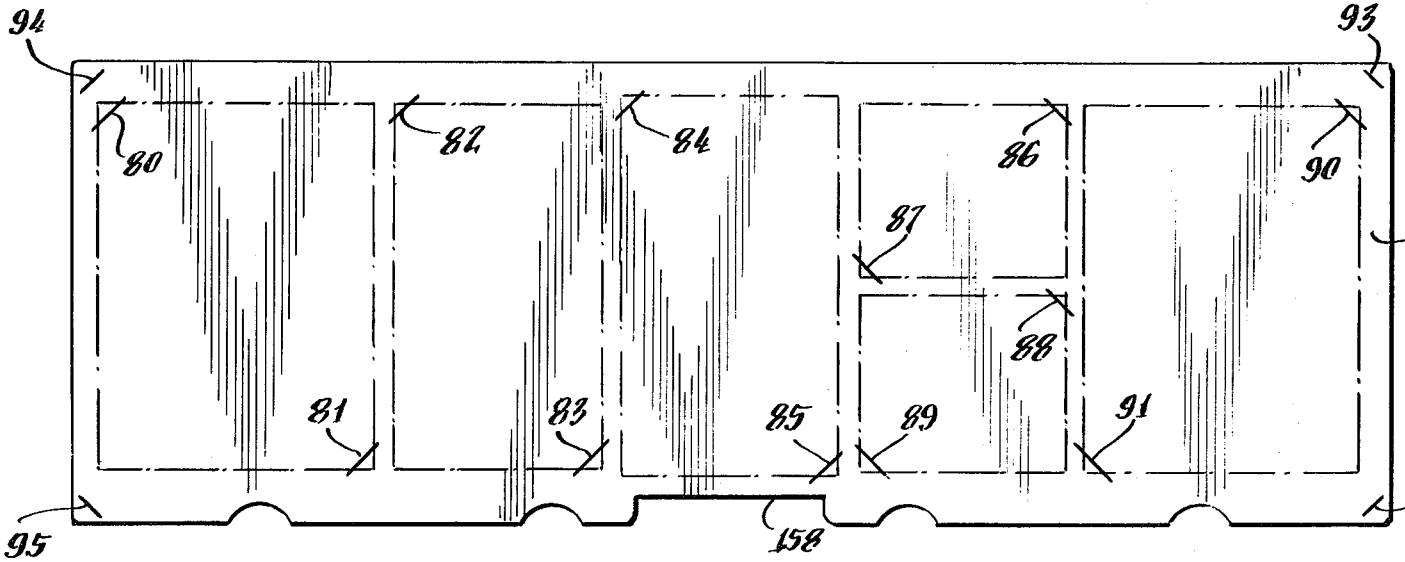
FIG. 9 is a front view of the backing plate of the frame assembly.

As shown in FIG. 9, backing plate 40 contains a plurality of slits 80–91 into which the corners of pictures or photographs may be placed. This arrangement provides a convenient method for mounting desired pictures in the picture frame of the present invention. Slits 80–91 are located such that when properly installed, the pictures will line up with corresponding viewing openings in front panel 46. Thus, for example, a picture having its corners placed in slits 80 and 81 will appear behind viewing opening 24 in the assembled picture frame. Similarly, a picture placed with its corners in slits 88 and 89 will appear behind viewing opening 30. If backing plate 40 has a mirrored front surface and, for example, no picture is put into slits 90 and 91, then when assembled, a mirror will appear behind viewing opening 34. The user may choose any of the viewing openings to serve as a mirror.

In one embodiment of the present invention, a transparent window is provided to protect the pictures from damage due to dirt or other contact that could cause surface scratches. The transparent window may be formed of a relatively thin transparent plastic sheet material. Slits 92, 93, 94, and 95 may be provided in the corners of backing plate 40 into which the corresponding corners of the transparent sheet may be placed.

Thus, as shown in FIG. 5, transparent sheet 44 will be sandwiched between backing plate 40 and front panel 46. In the areas where pictures are present (e.g. picture 42 shown in FIG. 5), the picture will also be sandwiched between backing plate 40 and front panel 46 with transparent sheet 44 directly covering the picture.

It will be appreciated that other mounting methods for both the pictures and the transparent sheet may be utilized. For example, pictures may be glued to the backing plate 40 with a suitable adhesive. Double sided adhesive tape may also be used. The mounting of the transparent sheet to backing plate 40 is optional. This sheet may be simply sandwiched between backing plate 40 and front panel 46.

After a user has properly positioned his pictures and mounted them on backing plate 40, he completes the picture frame assembly by sliding backing plate 40 with the pictures facing forward into the channels 54 provided on the back of front panel 46. When the top edge of backing plate 40 has been slid into engagement with the top of channel 54, the bottom edge of backing plate 40 may be pressed forward so that notch 158 slides along the angled edge of locking tab 52, deflecting locking tab 52 down until the edge of backing plate 40 clears the lip of locking tab 52. At this point, locking tab 52 will return to its normal, undeflected position and lock backing plate 40 into position. FIG. 5 is a side view of the completed assembly, showing the various elements thereof. FIG. 14 is an enlarged detail view of the locking tab arrangement. A front view of the assembly is shown in FIG. 3, and a top view in FIG. 2.

FIG. 6 shows the completed assembly taken substantially along the plane defined by line 6—6 in FIG. 3. This view shows the relationship of clip 160 to the various elements of the picture frame. As shown, gripper arm 64 extends from bottom portion 62 of clip 160 at an acute angle $\theta$. Bottom portion 62 extends from top portion 60 at an angle $\alpha$ with respect to the vertical. This arrangement results in an integral, spring loaded clip having two substantially parallel edges to grip a supporting surface, such as a visor, at each clip location.

Figure 12:
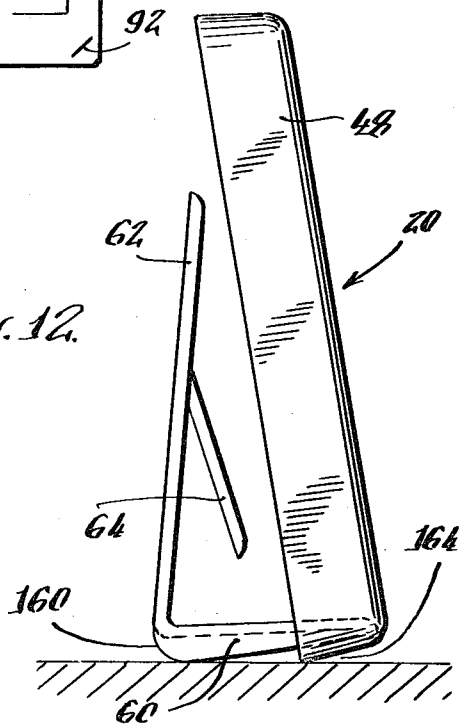
FIG. 12 is a side view showing the frame assembly sitting in an upright position on top of a table.

The design of clip 160 is such that the picture frame may be supported in an attractive manner on a table top. As shown in FIG. 12, picture frame assembly 20 sits on table 162 with the front surface thereof tilted rearwardly with respect to the vertical. Rear edge 164 of bottom member 146 and the corner of clip 160 where top portion 60 meets bottom portion 62 are the support ledges for the assembly.

Figure 15:
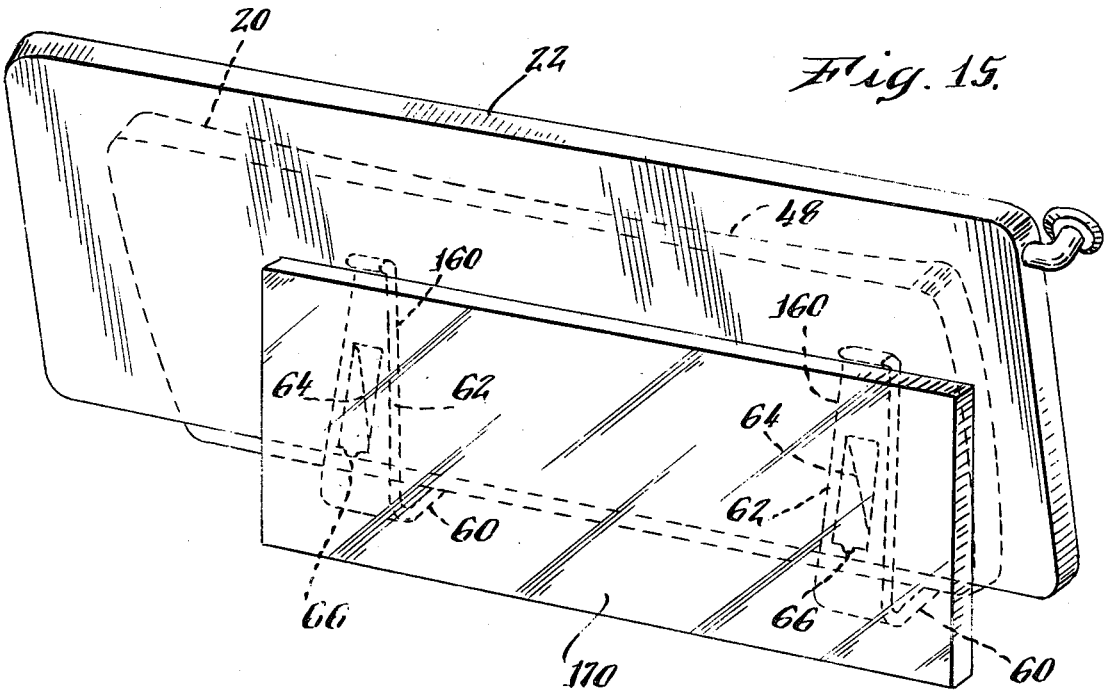
FIG. 15 is a rear view of the frame assembly showing a mirror attached to the rear sides of the mounting clips.

A mirror 170 may be mounted to the rear surface of mounting clips 160 as shown in FIG. 15. Mirror 170 comes into view when the sun visor 22 on which frame assembly 20 is mounted is rotated about its hinge.

It is noted that a variety of other constructions would be available for the picture frame assembly of the present invention. For example, clips 160 could be attached to frame member 48 by means of living hinges. The use of such a hinge would provide a flexible joint, allowing the clips to pivot at the interface between clip top portions 60 and top frame member portion 148. A mirror mounted to the clips with its reflective surface facing outwardly therefrom would move in conjunction with the clips when rotated.

While the invention has been described in connection with a preferred embodiment, it is not intended to limit the scope of the invention to the particular form set forth, but, on the contrary, it is intended to cover such alternatives, modifications and equivalents as may be included within the spirit and scope of the invention as defined by the appended claims.

What is claimed is:

1. For displaying a plurality of pictures, a frame assembly adapted to be detachably secured to the sun visor of an automotive vehicle or the like comprising:
   - a rigid frame member including a top, a bottom and a pair of side edges joining said top and bottom edges;
   - a front panel affixed to said frame member, said panel having a plurality of viewing openings therein;
   - a backing plate removably mounted within said frame member behind said front panel adapted to removably receive a plurality of pictures thereon behind said viewing openings in said front panel; and
   - at least one resilient clip integrally attached to said frame member and overlying the rear surface of said backing plate for mounting said assembly to another supporting surface, said clip including a substantially planar top portion extending rearwardly from and coplanar to the top edge of said frame member and a bottom portion extending downwardly from said top portion having a pair of generally parallel spaced edges for contacting said supporting surface in gripping relation thereto.

2. The frame assembly of claim 1 wherein said backing plate includes a plurality of slits into which the corners of a picture can be inserted, said slits being arranged to accommodate a plurality of pictures each in centered relation to a corresponding one of said viewing openings in said front panel.

3. The assembly of claim 1 or 2 wherein said front panel includes a pair of channels at opposed edges thereof for slidably receiving said backing plate and said frame member includes locking means for retaining said backing plate in said channels and against the rear side of said front panel.

4. The frame assembly of claim 1 wherein said frame member further comprises a plurality of stake pins projecting from the rear side and along the perimeter thereof, and said front panel includes a plurality of stake pin receptacles along the perimeter thereof corresponding to said pins.

5. The frame assembly of claim 4 wherein the receptacles along the perimeter of said front panel have beveled edges extending inwardly from the rear side thereof, said stake pins being heat staked within said receptacles to permanently affix said front panel to said frame member.

6. The frame assembly of claim 1 or 5 wherein said clip has a slot therein to facilitate the hanging of said assembly on a wall.

7. The frame assembly of claim 1 or 2 further comprising a sheet of transparent material sandwiched between said front panel and said backing plate.

8. The frame assembly of claim 7 wherein said backing plate includes slits disposed in at least two corners thereof into which corresponding corners of said transparent sheet are inserted.

9. The frame assembly of claim 1 wherein said backing plate includes a mirrored surface.

10. The frame assembly of claim 1, 2, 5 or 9 wherein the openings in said front panel are of different shapes and sizes.

11. The frame assembly of claim 1 or 5 further comprising a mirror having a front reflective surface and a rear surface, said rear surface being mounted to the rear side of said clip and said reflective surface facing outwardly from the rear side of said frame assembly.

12. The frame assembly of claim 1 wherein the bottom portion of said clip extends downwardly from said top portion and inwardly toward said backing plate, said bottom portion having a gripping arm extending upwardly at an acute angle from an intermediate portion thereof and inwardly toward said backing plate, said bottom portion further comprising a bottom edge and said gripping arm having a free top edge, said pair of generally parallel spaced edges comprising said bottom edge and said free top edge.

13. The frame assembly of claim 1 wherein the top of said frame member and the rearward area of said top portion of said clip define a plane at an obtuse angle with respect to the surface of said front panel, whereby said front panel can be tilted rearwardly and supported on a support surface when said clip is seated on a support surface.

* * * * *